US009933196B2

(12) United States Patent
Ghiasvand et al.

(10) Patent No.: US 9,933,196 B2
(45) Date of Patent: Apr. 3, 2018

(54) SYSTEM AND METHOD FOR SIMULTANEOUS COOLING AND HEATING OF SAMPLE MATRIX DURING SOLID AND LIQUID PHASE EXTRACTION METHODS

(71) Applicants: Ali Reza Ghiasvand, Khoram Abad (IR); Nahid Heidari, Khoram Ababd (IR); Shahriar Shadabi, Khoram Ababd (IR); Masoumeh Pirdadeh Beiranvand, Khoram Ababd (IR)

(72) Inventors: Ali Reza Ghiasvand, Khoram Abad (IR); Nahid Heidari, Khoram Ababd (IR); Shahriar Shadabi, Khoram Ababd (IR); Masoumeh Pirdadeh Beiranvand, Khoram Ababd (IR)

( * ) Notice: Subject to any disclaimer, the term of this patent is extended or adjusted under 35 U.S.C. 154(b) by 331 days.

(21) Appl. No.: 14/702,698

(22) Filed: May 2, 2015

(65) Prior Publication Data

US 2015/0233655 A1 Aug. 20, 2015

(51) Int. Cl.

| | |
|---|---|
| ***F25D 3/10*** | (2006.01) |
| ***B01L 7/00*** | (2006.01) |
| *F28D 21/00* | (2006.01) |
| *F25D 31/00* | (2006.01) |

(52) U.S. Cl.

CPC ..... *F25D 3/10* (2013.01); *B01L 7/50* (2013.01); *B01L 2200/0631* (2013.01); *B01L 2300/0854* (2013.01); *B01L 2300/185* (2013.01); *B01L 2300/1827* (2013.01); *B01L 2400/0666* (2013.01); *F25D 31/005* (2013.01); *F28D 2021/0077* (2013.01)

(58) Field of Classification Search

CPC .... F25D 3/10; F25D 7/00; F28F 27/00; F28F 9/007

See application file for complete search history.

(56) References Cited

U.S. PATENT DOCUMENTS

| | | | | |
|---|---|---|---|---|
| 8,307,665 | B2 * | 11/2012 | Nagamune | F25D 19/006 62/51.1 |
| 2005/0158781 | A1 * | 7/2005 | Woudenberg | B01L 3/5027 435/6.11 |
| 2013/0008182 | A1 * | 1/2013 | Hrudka | F25B 21/04 62/3.6 |
| 2014/0234949 | A1 * | 8/2014 | Wasson | G01N 35/1065 435/287.2 |

* cited by examiner

*Primary Examiner* — Frantz Jules
*Assistant Examiner* — Brian King

(57) ABSTRACT

The embodiments herein provide a low cost and effective system and method for simultaneous cooling and heating of a sample matrix during solid and liquid phase extraction methods. A cooling device is attached to atop of a sample vial and a heater is placed below the sample to simultaneous cooling and heating of the sample. The cooling device comprises two concentric metallic cylinders capped with welding. Two stainless steel capillary tubes are inserted respectively into two ends of the capped space for passing in and exiting out liquid carbon dioxide from the cooling device to cool the extracted analytes. The dimensions of the cylinders in the cooling device are suitably adjusted so that the cooling device is suited for use in liquid phase as well as solid phase micro-extraction processes.

17 Claims, 8 Drawing Sheets

SYSTEM AND METHOD FOR SIMULTANEOUS COOLING AND HEATING OF SAMPLE MATRIX DURING SOLID AND LIQUID PHASE EXTRACTION METHODS

BACKGROUND

Technical Field

The embodiments herein generally relate to extraction systems for solid and liquid phase samples. The embodiments herein particularly relate to a system and a method for simultaneous cooling and heating of sample matrix during solid and liquid phase extraction methods. The embodiments herein more particularly relate to a low cost and effective system and method for simultaneous cooling and heating of sample matrix during solid and liquid phase extraction methods.

Description of the Related Art

One of the best strategies for employed in extraction processes of solid and liquid samples for releasing analytes is heating the sample matrix. However heating the sample has a bilateral effect as an extraction fiber is also heated. Consequently the heating of extraction fiber reduces a distribution coefficient of released analytes between a headspace over the sample and the extraction fiber.

For providing an optimum temperature for any solid or liquid phase micro-extraction method with a substantial extraction efficiency, Cold-Fiber SPME (CFSPME) technique was developed [Z. Zhang, J. Pawliszyn, Anal. Chem 67 (1995) 34]. In said method, the sample is heated while the fiber is simultaneously kept cool. Due to this, the distribution coefficient between the headspace and a coating of the extraction fiber increases and results in increasing the extraction efficiency compared to conventional methods. Various other cold fiber solid phase microextraction systems were designed in 2004[K.-J. Chia, T.-Y. Lee, S.-D. Huang, Anal. Chim. Acta 527 (2004) 157], 2006 [A. R. Ghiasvand, S. Hosseinzadeh, J. Pawliszyn, J. Chromatogr. A1124 (2006) 35], 2009 [S. H. Haddadi, J. Pawliszyn, J. Chromatogr. A1216 (2009) 2783] and 2011 [H. C. Menezes, Z. de Lourdes Cardeal, J. Chromatogr. A1218 (2011) 3300].

However, among the reported strategies, the most effective technique is internally-cooled SPME [Z. Zhang, J. Pawliszyn, Anal. Chem. 67 (1995) 34]. The internally-cooled SPME is efficient but is a complicated and multipart method. The fabrication and automation process is tedious and suffers from a lack of precise control of a flow rate of coolant such as liquid-carbon dioxide. Consequently, there is a lack of precise control of temperature of a fibe. Additionally, the abovementioned method is limited only to one type of fiber (i.e. PDMS).

Hence, there is a need for a development of a simple, low cost and effective cooling-assisted-method suitable for both Solid Phase Micro-Extraction (SPME) and Liquid Phase Micro-Extraction (LPME) methods.

The abovementioned shortcomings, disadvantages and problems are addressed herein and which will be understood by reading and studying the following specification.

OBJECTS OF THE EMBODIMENTS HEREIN

The primary object of the embodiments herein is to provide a system and method for simultaneous cooling and heating of sample matrix during solid and liquid phase extraction methods.

Another object of the embodiments herein is to provide a system and method to enable low cost and effective cooling-assisted-method for Solid Phase Micro-Extraction (SPME) and Liquid Phase Micro-Extraction (LPME) methods.

Yet another object of the embodiments herein is to provide a device that is coupled to headspace of solid-phase micro-extraction (CHD-HS-SPME) capsule or device to enable cooling of extraction fibers for effective tapping of volatiles in the headspace of complex solid matrices with minimal manipulation as compared to traditional SPME methods.

Yet another object of the embodiments herein is to provide a device that is optimized and evaluated to use in cooling of an extraction phase in hollow-fiber based liquid phase micro-extraction (CHD-HF-HS-LPME) method.

Yet another object of the embodiment herein is to provide a system and method to enable low cost and effective cooling-assisted-method for Solid Phase Micro-Extraction (SPME) and Liquid Phase Micro-Extraction (LPME) methods with precise temperature control mechanism for the coolant material.

Yet another object of the embodiments herein is to provide a system and method for cooling-assisted-method for Solid Phase Micro-Extraction (SPME) and Liquid Phase Micro-Extraction (LPME) to enable a use of volatile organic solvents in headspace of cooling heating device (CHD) in micro-extraction analysis methods.

Yet another object of the embodiments herein is to enable tracking and early detection of incurable diseases through a measurement of target compounds in human breath.

Yet another object of the embodiments herein is to develop a method and a system for cooling-assisted-method for Solid Phase Micro-Extraction (SPME) and Liquid Phase Micro-Extraction (LPME) methods to enable a use of volatile organic solvents in headspace of microextraction analysis methods due to a possibility of fine adjustment of the temperature and set temperature values of the fiber to very low values.

Yet another object of the embodiments herein is to develop a method and a system for cooling-assisted-method for Solid Phase Micro-Extraction (SPME) and Liquid Phase Micro-Extraction (LPME) methods for use in industry, medicinal and agricultural products, pollutant/contaminated environments, pharmaceuticals, medicinal herbs, and nanomaterials.

Yet another object of the embodiments herein is to develop a method and a system for cooling-assisted-method for Solid Phase Micro-Extraction (SPME) and Liquid Phase Micro-Extraction (LPME) methods to enable direct analysis of polycyclic aromatic hydrocarbons (PAH) in contaminated soil samples in one step and without any sample preparation process.

These and other objects and advantages of the embodiments herein will become readily apparent from the following summary and the detailed description taken in conjunction with the accompanying drawings.

SUMMARY

The various embodiments herein provide a system and method for enabling simultaneous heating and cooling of sample matrix during solid or liquid phase micro-extraction processes.

According to an embodiment herein, a system is provided for simultaneous heating and cooling of sample matrix during solid or liquid phase micro-extraction processes. The system comprises a sample vial to hold a sample matrix from which analytes are extracted using solid or liquid phase micro-extraction process. A heating arrangement is provided below the sample vial to heat the sample matrix in the sample vial and the heating arrangement is a micro-heater. A cooling device is attached to a top of the sample vial for cooling the sample matrix. A carbon dioxide source is connected to the cooling device to supply a liquid carbon dioxide to the cooling device for cooling the sample matrix. A solenoid valve is provided between the carbon dioxide source and the cooling device. The solenoid valve is configured to act as an interface. A temperature controller module is connected to the cooling device and the solenoid valve to control a temperature of the cooling device. A thermocouple module is connected between the temperature controller and the cooling device to measure a temperature of the cooling device. An extraction vial is provided at a headspace of the sample vial for receiving an analyte extracted from the sample during solid or liquid phase micro-extraction processes. A power line is connected to the temperature controller module. The solenoid valve is heated and cooled simultaneously during the extraction process to increase a release of analytes from the sample.

According to an embodiment herein, the cooling device comprises an outer metallic cylinder and an inner metallic cylinder placed concentrically inside the outer metallic cylinder for housing the sample vial comprising the sample matrix, An inlet metallic tube is inserted into the cooling device for passing the liquid carbon dioxide into a space between the outer metallic cylinder and the inner metallic cylinder for cooling the sample matrix in the sample vial. An outer metallic tube is provided for exiting the liquid carbon dioxide from the cooling device. A holder mechanism is provided to hold the cooling device in place and enable extraction of the analytes. The sample vial is heated and cooled simultaneously during the extraction process to increase a release of analytes from the sample.

According to an embodiment herein, a size of the outer metallic cylinder and a size of the inner metallic cylinder are suitable adjusted so that the cooling device is configured for use in liquid phase micro-extraction and/or solid phase micro-extraction processes.

According to an embodiment herein, the space between the outer metallic cylinder and the inner metallic cylinder is capped with a disc and the disc is welded to the space.

According to an embodiment herein, the inlet metallic tube and the outer metallic tube are stainless steel capillary tubes. The inlet metallic tube is inserted into the space at one end of the capped space for passing liquid carbon dioxide inside the cooling device and the outer metallic tube is inserted at another end of the capped space for exiting liquid carbon dioxide out of the cooling device. Both the inlet stainless steel capillary tube and the outlet stainless steel tube are stainless steel tube of 22 Gauge.

According to an embodiment herein, the outer metallic cylinder and the inner metallic cylinders are copper cylinder.

According to an embodiment herein, the thermocouple module comprises a K-type (Alum-Chrome) thermocouple and the wires of the thermocouple are inserted into the sample vial to measure a temperature of the sample vial.

According to an embodiment herein, the temperature controller regulates switch on/off operation of the solenoid valve based on a measured temperature of the sample vial to control a flow of the liquid carbon di-oxide into the space to adjust a temperature of the cooling device to preset value.

According to an embodiment herein, the system further comprise micro-syringe with a needle inserted into the extraction vial to hold the analytes in center of the extraction vial and to hold the analytes for analysis.

According to an embodiment herein, a method is provided for simultaneous heating and cooling of sample matrix during solid or liquid phase micro-extraction processes. The method comprises placing a sample matrix in a sample vial. The sample vial is placed inside a cooling device. The sample in the sample matrix is heated with a heater arrangement. The heater is a micro-heater and the sample is heated for preset time to attain an equilibrium of sample in the head space of the sample vial. An extraction vial is placed into a head space of the sample vial for receiving an analyte extracted from the sample matrix in the sample vial. A needle of a syringe is inserted into the extraction vial to receive and hold the analytes at the center of the extraction vial. Liquid carbon dioxide is delivered from a carbon dioxide source to the cooling device through a solenoid valve and stainless steel tubes to cool the analytes sample vial. The analytes are cooled to preset temperature. The analytes are extracted at the needle at a preset time. The analytes are injected into a chromatographic or spectroscopic instrument for analysis of polycyclic aromatic hydrocarbons (PAHs). The sample is simultaneously heated and cooled simultaneously during the extraction process to increase a release of analytes from the sample.

According to an embodiment herein, the sample is placed in a space between two copper tubes in the cooling device.

According to an embodiment herein, liquid carbon dioxide is passed into the space between the two copper tubes in the cooling device and depressurized.

According to an embodiment herein, the space is cooled due to depressurization of liquid carbon di-oxide.

According to an embodiment herein, the method further comprises connecting a temperature controller module to the cooling device and the solenoid valve to control a temperature of the cooling device.

According to an embodiment herein, the method further comprises connecting a thermocouple module between the temperature controller and the cooling device to measure a temperature of the cooling device.

According to an embodiment herein, the method further comprises controlling a switching on/off operations of the solenoid valve based on a measured temperature of the cooling device to regulate a flow of the carbon di oxide to maintain a temperature of the cooling device at a preset value.

According to an embodiment herein, the method further comprises adjusting a size of the two copper tubes in the cooling device so that the cooling device is configured for use in liquid phase micro-extraction and/or solid phase micro-extraction processes.

The various embodiments herein provide a system and method for enabling simultaneous heating and cooling of sample matrix during solid or liquid phase micro-extraction processes. The system comprises a sample matrix for extracting analytes using solid or liquid phase micro-extraction process, a sample vial to hold the sample matrix, a heating arrangement to heat the sample vial, a cooling device attached to a top of the sample vial to enable simultaneous heating and cooling of the sample, a carbon dioxide source to supply liquid carbon dioxide to the cooling device to cool the sample matrix, a solenoid valve acting as an interface between the carbon dioxide source and the cooling device, a temperature controller module connected to the cooling device and the solenoid valve to regulate a switching ON and OFF operations of the cooling device, a holder mechanism for holding the cooling device in place inside the sample vial, a thermocouple module connected between the temperature controller and the cooling device, and a power supply line connected between the temperature controller and the solenoid valve.

According to an embodiment herein, the cooling device is configured to cool the analytes during a micro-extraction process. The cooling device comprises two concentric metallic cylinders with space between the cylinders so that the liquid carbon dioxide flows through the space between the cylinders. Two metallic tubes are arranged in the cooling device for passing the liquid carbon dioxide into the cooling device and for exiting the liquid carbon dioxide from the cooling device. A holder mechanism is provided to hold the cooling device in place and to enable an extraction of the analytes.

According to an embodiment herein, a holder mechanism is arranged inside the cooling device. The dimensions of the concentric cylinders in the cooling device are suitably adjusted so that the cooling device is suitable for use in both liquid phase micro-extraction and solid phase micro-extraction processes.

According to an embodiment herein, the space between the metallic cylinders in cooling device is capped with welding. Two stainless steel capillary tubes are inserted in one end of the capped space for passing liquid carbon dioxide in and out of the device.

According to an embodiment herein, the outer copper cylinder in the cooling device has an outer diameter of 6.3 mm, inner diameter of 5.5 mm and a length of 2 cm. The inner copper cylinder in the cooling device has an outer diameter of 3 mm, inner diameter of 1.2 mm and a length of 2.5 cm. Both stainless steel capillary tubes are made with stainless steel having a gauge of 22.

According to an embodiment herein, a cooling process is provided to cool the sample inside the cooling heating device. The method comprises following steps. A liquid carbon dioxide is supplied from a liquid carbon dioxide source to the cooling device through a solenoid valve and a stainless steel tube. The liquid carbon dioxide is passed into a space between the two copper tubes in the cooling device and is depressurized. The depressurization of the liquid carbon dioxide cools an internal space in the cooling device. Subsequently, the extraction phase (SPME fiber or micro-droplet of organic solvent in LPME methods) is also cooled. A thermocouple is connected to a manual temperature controller to adjust the temperature of the cooling capsule to preset values. A temperature controller is also connected to a solenoid valve and switches the solenoid into ON and OFF modes to control a temperature of cooling capsule. According to one embodiment herein, the temperature controller is operated manually or automatically to control a flow of the liquid carbon dioxide gas through solenoid valves based on a measured temperature of the cooling capsule with the thermocouple.

According to an embodiment herein, a method for liquid phase micro-extraction and solid phase micro-extraction processes using a cooling and heating device is provided. The method comprises the following steps of designing and constructing of cooling capsule, thermocouple and temperature controller. The thermocouple is connected to cooling capsule and temperature controller. A liquid carbon dioxide tank is connected to the cooling capsule through a solenoid valve and the liquid carbon dioxide is passed into the cooling capsule using stainless steel tube. The cooling capsule is mounted inside an extraction vial containing liquid or solid sample. A preset temperature is set for the cooling capsule by the user to regulate a flow of the liquid carbon dioxide through the solenoid valve with a temperature controller based on the measured temperature of the cooling capsule by the thermocouple. The sample is heated for a given period of time for achieving equilibration between sample and headspace. The needle of a micro-syringe is passed through the septum into the cooling capsule. The needle is exposed to headspace of the sample and the sample is driven out in the extraction phase. Analytes are extracted onto extraction phase at a predetermined time. The extraction sample is collected into the needle of micro-syringe during the extraction phase and the extracted sample is injected to chromatographic or spectroscopic instrument for analysis According to an embodiment herein, an optimal analysis of real complex matrices for solid phase micro-extraction process is provided. The extraction and trapping is carried out by using a 100 μm PDMS commercial fiber. Standard sand samples in the form of matrix model and spiked with PAHs are used to study the effect of different experimental parameters including temperature of the heated sample matrix, temperature of the cooled fiber, extraction time, moisture content, and a volume of the cooling capsule. The best recovery for PAHs examined using the method is obtained at the following conditions. The temperature of sample matrix is kept at 150° C. and the temperature of fiber is maintained at 0° C. The sample is extracted for 10 min, and the moisture content is maintained at 20 μl of water per 10 g of sample. A good linearity is observed for the extraction and determination of PAHs over the range of 0.0015-10 μgg-1. The Linear Dynamic Range (LDR), and the LOD (limit of detection) for the analytes is within a range of 0.47 to 0.89 ngg-1 and relative standard deviations is within a range of 5.9 to 10.3% (RSD, n=6). For evaluation of the device, the results are compared to conventional extraction from solid samples. The results revealed that the CHD-SPME is more effective in cooling the absorbent and increasing of the extraction efficiency and consequently showed better recoveries. The CHD-SPME device, is applied for the extraction and determination of PAHs in polluted soil samples, obtained from different parts of asphalt factories. Good agreement is observed between the results obtained by the device and those obtained by standard methods.

According to an embodiment herein, an optimal analysis of real complex matrices for liquid phase micro-extraction process is provided. The device is coupled to hollow-fiber based liquid phase micro-extraction method using low boiling point organic solvents. The type and volume of extraction of organic solvent, extraction time, temperature of sample and temperature of the cooled organic drop are considered as the most important parameters and are studied. The obtained optimal conditions are as follows: 3 μL of acetone is used as an extracting organic solvent and the sample is extracted for 20 min at an extraction temperature of 90° C. The organic drop is cooled to a temperature of −25° C. Using the system and method, a good linearity is observed in the preset concentration ranges. The method is successfully applied for the extraction and determination of the PAHs in contaminated complex soil samples.

According to an embodiment herein, a system for cooling the extraction phase in solid phase micro-extraction and liquid phase micro-extraction is provided. The system comprise a carbon dioxide tank, a solenoid valve, a temperature controller, a sample vial, a cooling device, a holder mechanism, a heater and stirrer module, a power line and a thermocouple. A Carbon dioxide tank that delivers liquid Carbon dioxide is connected to the cooling device through a solenoid valve and the holder mechanism. Liquid Carbon dioxide enters the cooling device. Due to depressurization, the internal space in the cooling device is cooled and this causes the cooling of extraction phase. A thermocouple is connected to the cooling device and a temperature controller. The temperature controller adjusts the temperature of the cooling device to preset values. The temperature controller is also connected to the solenoid valve to control the switching ON and OFF of the cooling device. A suitable amount of sample matrix (not shown in the figure) is placed in a sample vial and a cooling device is fitted to the top cap of the sample vial. A suitable heater and stirrer module heats the sample to release target analytes into the headspace of sample vial. After equilibration between sample and headspace, a needle of a syringe containing micro-extraction fluid is passed through the extraction vial's cap and entered into inner part of the cooling device. The cooling process starts immediately and cools down the extraction phase, which is located inside the cooling capsule. After trapping of analytes onto the extraction phase the fluid driven back into the needle and immediately injected to chromatographic system for subsequent analysis.

According to an embodiment herein, a cooling device for cooling the extraction phase in liquid phase micro-extraction and solid phase micro-extraction methods is provided. The Cooling devices are used in liquid phase and solid phase micro-extraction process. The device comprises an outer cylinder, an inner cylinder, an inlet tube, an outlet tube and a holder mechanism. The Liquid carbon dioxide enters the cooling device through the inlet tube, into the space in between the outer cylinder and inner cylinder and then exits out of the cooling device through the outlet tube. The holder mechanism holds the parts of the cooling device in their places.

According to an embodiment herein, a cooling and heating apparatus for liquid phase micro-extraction and solid phase micro-extraction methods, is provided. The system comprises a sample vial, the sample matrix, a lid and the cooling device. The sample matrix is heated by heating the sample vial and simultaneously cooled by passing liquid carbon dioxide through the cooling device. The liquid carbon dioxide enters the cooling device through the inlet pipe, cools the sample matrix and exits through the outlet pipe.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
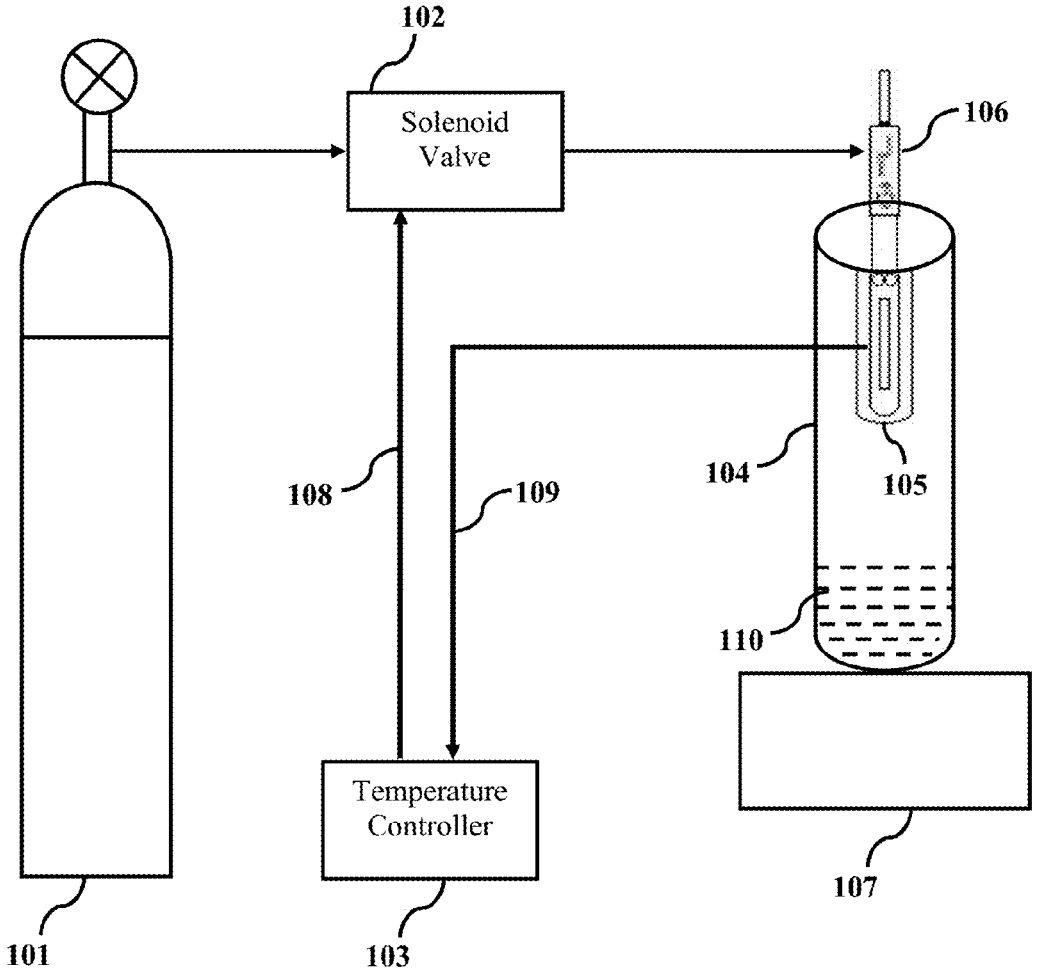
FIG. 1 illustrates a block diagram of a system for cooling the extraction phase in solid phase micro-extraction and liquid phase micro-extraction, according to an embodiment herein.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

DETAILED DESCRIPTION OF THE EMBODIMENTS HEREIN

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a system and method for enabling simultaneous heating and cooling of sample matrix during solid or liquid phase micro-extraction processes.

According to an embodiment herein, a system is provided for simultaneous heating and cooling of sample matrix during solid or liquid phase micro-extraction processes. The system comprises a sample vial to hold a sample matrix from which analytes are extracted using solid or liquid phase micro-extraction process. A heating arrangement is provided below the sample vial to heat the sample matrix in the sample vial and the heating arrangement is a micro-heater. A cooling device is attached to a top of the sample vial for cooling the sample matrix. A carbon dioxide source is connected to the cooling device to supply a liquid carbon dioxide to the cooling device for cooling the sample matrix. A solenoid valve is provided between the carbon dioxide source and the cooling device. The solenoid valve is configured to act as an interface. A temperature controller module is connected to the cooling device and the solenoid valve to control a temperature of the cooling device. A thermocouple module is connected between the temperature controller and the cooling device to measure a temperature of the cooling device. An extraction vial is provided at a headspace of the sample vial for receiving an analyte extracted from the sample during solid or liquid phase micro-extraction processes. A power line is connected to the temperature controller module. The solenoid valve is heated and cooled simultaneously during the extraction process to increase a release of analytes from the sample.

According to an embodiment herein, the cooling device comprises an outer metallic cylinder and an inner metallic cylinder placed concentrically inside the outer metallic cylinder for housing the sample vial comprising the sample matrix, An inlet metallic tube is inserted into the cooling device for passing the liquid carbon dioxide into a space between the outer metallic cylinder and the inner metallic cylinder for cooling the sample matrix in the sample vial. An outer metallic tube is provided for exiting the liquid carbon dioxide from the cooling device. A holder mechanism is provided to hold the cooling device in place and enable extraction of the analytes. The sample vial is heated and cooled simultaneously during the extraction process to increase a release of analytes from the sample.

According to an embodiment herein, a size of the outer metallic cylinder and a size of the inner metallic cylinder are suitable adjusted so that the cooling device is configured for use in liquid phase micro-extraction and/or solid phase micro-extraction processes.

According to an embodiment herein, the space between the outer metallic cylinder and the inner metallic cylinder is capped with a disc and the disc is welded to the space.

According to an embodiment herein, the inlet metallic tube and the outer metallic tube are stainless steel capillary tubes. The inlet metallic tube is inserted into the space at one end of the capped space for passing liquid carbon dioxide inside the cooling device and the outer metallic tube is inserted at another end of the capped space for exiting liquid carbon dioxide out of the cooling device. Both the inlet stainless steel capillary tube and the outlet stainless steel tube are stainless steel tube of 22 Gauge.

According to an embodiment herein, the outer metallic cylinder and the inner metallic cylinders are copper cylinder.

According to an embodiment herein, the thermocouple module comprises a K-type (Alum-Chrome) thermocouple and the wires of the thermocouple are inserted into the sample vial to measure a temperature of the sample vial.

According to an embodiment herein, the temperature controller regulates switch on/off operation of the solenoid valve based on a measured temperature of the sample vial to control a flow of the liquid carbon di-oxide into the space to adjust a temperature of the cooling device to preset value.

According to an embodiment herein, the system further comprise micro-syringe with a needle inserted into the extraction vial to hold the analytes in center of the extraction vial and to hold the analytes for analysis.

According to an embodiment herein, a method is provided for simultaneous heating and cooling of sample matrix during solid or liquid phase micro-extraction processes. The method comprises placing a sample matrix in a sample vial. The sample vial is placed inside a cooling device. The sample in the sample matrix is heated with a heater arrangement. The heater is a micro-heater and the sample is heated for preset time to attain an equilibrium of sample in the head space of the sample vial. An extraction vial is placed into a head space of the sample vial for receiving an analyte extracted from the sample matrix in the sample vial. A needle of a syringe is inserted into the extraction vial to receive and hold the analytes at the center of the extraction vial. Liquid carbon dioxide is delivered from a carbon dioxide source to the cooling device through a solenoid valve and stainless steel tubes to cool the analytes sample vial. The analytes are cooled to preset temperature. The analytes are extracted at the needle at a preset time. The analytes are injected into a chromatographic or spectroscopic instrument for analysis of polycyclic aromatic hydrocarbons (PAHs). The sample is simultaneously heated and cooled simultaneously during the extraction process to increase a release of analytes from the sample.

According to an embodiment herein, the sample is placed in a space between two copper tubes in the cooling device.

According to an embodiment herein, liquid carbon dioxide is passed into the space between the two copper tubes in the cooling device and depressurized.

According to an embodiment herein, the space is cooled due to depressurization of liquid carbon di-oxide.

According to an embodiment herein, the method further comprises connecting a temperature controller module to the cooling device and the solenoid valve to control a temperature of the cooling device.

According to an embodiment herein, the method further comprises connecting a thermocouple module between the temperature controller and the cooling device to measure a temperature of the cooling device.

According to an embodiment herein, the method further comprises controlling a switching on/off operations of the solenoid valve based on a measured temperature of the cooling device to regulate a flow of the carbon di oxide to maintain a temperature of the cooling device at a preset value.

According to an embodiment herein, the method further comprises adjusting a size of the two copper tubes in the cooling device so that the cooling device is configured for use in liquid phase micro-extraction and/or solid phase micro-extraction processes.

The various embodiments herein provide a system and method for enabling simultaneous heating and cooling of sample matrix during solid or liquid phase micro-extraction processes. The system comprises a sample matrix for extracting analytes using solid or liquid phase micro-extraction process, a sample vial to hold the sample matrix, a heating arrangement to heat the sample vial, a cooling device attached to a top of the sample vial to enable simultaneous heating and cooling of the sample, a carbon dioxide source to supply liquid carbon dioxide to the cooling device to cool the sample matrix, a solenoid valve acting as an interface between the carbon dioxide source and the cooling device, a temperature controller module connected to the cooling device and the solenoid valve to regulate a switching ON and OFF operations of the cooling device, a holder mechanism for holding the cooling device in place inside the sample vial, a thermocouple module connected between the temperature controller and the cooling device, and a power supply line connected between the temperature controller and the solenoid valve.

According to an embodiment herein, the cooling device is configured to cool the analytes during a micro-extraction process. The cooling device comprises two concentric metallic cylinders with space between the cylinders so that the liquid carbon dioxide flows through the space between the cylinders. Two metallic tubes are arranged in the cooling device for passing the liquid carbon dioxide into the cooling device and for exiting the liquid carbon dioxide from the cooling device. A holder mechanism is provided to hold the cooling device in place and to enable an extraction of the analytes.

According to an embodiment herein, a holder mechanism is arranged inside the cooling device. The dimensions of the concentric cylinders in the cooling device are suitably adjusted so that the cooling device is suitable for use in both liquid phase micro-extraction and solid phase micro-extraction processes.

According to an embodiment herein, the space between the metallic cylinders in cooling device is capped with welding. Two stainless steel capillary tubes are inserted in one end of the capped space for passing liquid carbon dioxide in and out of the device.

According to an embodiment herein, the outer copper cylinder in the cooling device has an outer diameter of 6.3 mm, inner diameter of 5.5 mm and a length of 2 cm. The inner copper cylinder in the cooling device has an outer diameter of 3 mm, inner diameter of 1.2 mm and a length of 2.5 cm. Both stainless steel capillary tubes are made with stainless steel having a gauge of 22.

According to an embodiment herein, a cooling process is provided to cool the sample inside the cooling heating device. The method comprises following steps. A liquid carbon dioxide is supplied from a liquid carbon dioxide source to the cooling device through a solenoid valve and a stainless steel tube. The liquid carbon dioxide is passed into a space between the two copper tubes in the cooling device and is depressurized. The depressurization of the liquid carbon dioxide cools an internal space in the cooling device. Subsequently, the extraction phase (SPME fiber or micro-droplet of organic solvent in LPME methods) is also cooled. A thermocouple is connected to a manual temperature controller to adjust the temperature of the cooling capsule to preset values. A temperature controller is also connected to a solenoid valve and switches the solenoid into ON and OFF modes to control a temperature of cooling capsule. According to one embodiment herein, the temperature controller is operated manually or automatically to control a flow of the liquid carbon dioxide gas through solenoid valves based on a measured temperature of the cooling capsule with the thermocouple.

According to an embodiment herein, a method for liquid phase micro-extraction and solid phase micro-extraction processes using a cooling and heating device is provided. The method comprises the following steps of designing and constructing of cooling capsule, thermocouple and temperature controller. The thermocouple is connected to cooling capsule and temperature controller. A liquid carbon dioxide tank is connected to the cooling capsule through a solenoid valve and the liquid carbon dioxide is passed into the cooling capsule using stainless steel tube. The cooling capsule is mounted inside an extraction vial containing liquid or solid sample. A preset temperature is set for the cooling capsule by the user to regulate a flow of the liquid carbon dioxide through the solenoid valve with a temperature controller based on the measured temperature of the cooling capsule by the thermocouple. The sample is heated for a given period of time for achieving equilibration between sample and headspace. The needle of a micro-syringe is passed through the septum into the cooling capsule. The needle is exposed to headspace of the sample and the sample is driven out in the extraction phase. The analytes are extracted during an extraction phase at a predetermined time. The extraction sample is collected into the needle of micro-syringe during the extraction phase and the extracted sample is injected to chromatographic or spectroscopic instrument for analysis According to an embodiment herein, an optimal analysis of real complex matrices for solid phase micro-extraction process is provided. The extraction and trapping is carried out by using a 100 μm PDMS commercial fiber. Standard sand samples in the form of matrix model and spiked with PAHs are used to study the effect of different experimental parameters including temperature of the heated sample matrix, temperature of the cooled fiber, extraction time, moisture content, and a volume of the cooling capsule. The best recovery for PAHs examined using the method is obtained at the following conditions. The temperature of sample matrix is kept at 150° C. and the temperature of fiber is maintained at 0° C. The sample is extracted for 10 min, and the moisture content is maintained at 20 μl of water per 10 g of sample. A good linearity is observed for the extraction and determination of PAHs over the range of 0.0015-10 μgg-1. The Linear Dynamic Range (LDR), and the LOD (limit of detection) for the analytes is within a range of 0.47 to 0.89 ngg-1 and relative standard deviations is within a range of 5.9 to 10.3% (RSD, n=6). For evaluation of the device, the results are compared to conventional extraction from solid samples. The results revealed that the CHD-SPME is more effective in cooling the absorbent and increasing of the extraction efficiency and consequently showed better recoveries. The CHD-SPME device, is applied for the extraction and determination of PAHs in polluted soil samples, obtained from different parts of asphalt factories. Good agreement is observed between the results obtained by the device and those obtained by standard methods.

According to an embodiment herein, an optimal analysis of real complex matrices for liquid phase micro-extraction process is provided. The device is coupled to hollow-fiber based liquid phase micro-extraction method using low boiling point organic solvents. The type and volume of extraction of organic solvent, extraction time, temperature of sample and temperature of the cooled organic drop are considered as the most important parameters and are studied. The obtained optimal conditions are as follows: 3 μL of acetone is used as an extracting organic solvent and the sample is extracted for 20 min at an extraction temperature of 90° C. The organic drop is cooled to a temperature of −25° C. Using the system and method, a good linearity is observed in the preset concentration ranges. The method is successfully applied for the extraction and determination of the PAHs in contaminated complex soil samples.

According to an embodiment herein, a system for cooling the extraction phase in solid phase micro-extraction and liquid phase micro-extraction is provided. The system comprise a carbon dioxide tank, a solenoid valve, a temperature controller, a sample vial, a cooling device, a holder mechanism, a heater and stirrer module, a power line and a thermocouple. A Carbon dioxide tank that delivers liquid Carbon dioxide is connected to the cooling device through a solenoid valve and the holder mechanism. Liquid Carbon dioxide enters the cooling device. Due to depressurization, the internal space in the cooling device is cooled and this causes the cooling of extraction phase. A thermocouple is connected to the cooling device and a temperature controller. The temperature controller adjusts the temperature of the cooling device to preset values. The temperature controller is also connected to the solenoid valve to control the switching ON and OFF of the cooling device. A suitable amount of sample matrix (not shown in the figure) is placed in a sample vial and a cooling device is fitted to the top cap of the sample vial. A suitable heater and stirrer module heats the sample to release target analytes into the headspace of sample vial. After equilibration between sample and headspace, a needle of a syringe containing micro-extraction fluid is passed through the extraction vial's cap and entered into inner part of the cooling device. The cooling process starts immediately and cools down the extraction phase, which is located inside the cooling capsule. After trapping of analytes onto the extraction phase the fluid driven back into the needle and immediately injected to chromatographic system for subsequent analysis.

According to an embodiment herein, a cooling device for cooling the extraction phase in liquid phase micro-extraction and solid phase micro-extraction methods is provided. The Cooling devices are used in liquid phase and solid phase micro-extraction process. The device comprises an outer cylinder, an inner cylinder, an inlet tube, an outlet tube and a holder mechanism. The Liquid carbon dioxide enters the cooling device through the inlet tube, into the space in between the outer cylinder and inner cylinder and then exits out of the cooling device through the outlet tube. The holder mechanism holds the parts of the cooling device in their places.

According to an embodiment herein, a cooling and heating apparatus for liquid phase micro-extraction and solid phase micro-extraction methods, is provided. The system comprises a sample vial, the sample matrix, a lid and the cooling device. The sample matrix is heated by heating the sample vial and simultaneously cooled by passing liquid carbon dioxide through the cooling device. The liquid carbon dioxide enters the cooling device through the inlet pipe, cools the sample matrix and exits through the outlet pipe.

The system provide an efficient, low coast and simple cooling assisted system, suitable for analyzing all type of matrices (liquid and solid samples). Using the simultaneous heating/cooling device (CHD), volatile analytes are directly extracted from complicate solid matrices in a single step, without any sample preparation processes. It also enables analytical chemists to use volatile solvents in single drop microextraction methods, for the first time. The cooling device is suitable to cool down the extraction phase, when coupled to headspace solid-phase microextraction (CHD-HS-SPME) and headspace liquid-phase microextraction (CHD-HS-LPME) methods. This system creates large temperature gaps between the extraction phase and the sample matrix (up to 200° C.), because the cooling process is directly applied onto the extraction phase.

The cooling system contains a (10 L) tank which delivers liquid CO2 through a solenoid valve and proper stainless steel tubing. A liquid CO2 is passed into the space between the two copper tubes in the cooling capsule and is depressurized. The depressurization cools internal space of the central copper tube (to −20° C.), and consequently the extraction phase (SPME fiber or microdroplet of organic solvent in LPME methods) is also cooled. A K-type thermocouple (Alum-Chrome), is connected to a manual temperature controller to adjust the temperature of the cooling capsule to preset values. The manual temperature controller is connected also to a solenoid valve and switches it on/off to control the temperature of cooling capsule. A proper amount of sample (liquid or solid) is placed into extraction vial. The cooling capsule (with thermocouple wires and CO2 enter and exit tubing) is fixed on the cap of the vial and is also placed into the extraction vial. A suitable electrical heater, is provided to heat the sample to release target analytes into the headspace of sample at a predetermined time. After attaining an equilibration of sample in head space, needle of a syringe containing SPME fiber of liquid phase of LPME, is passed through the septum of the extraction vial's cap and inserted into inner part of the cooling capsule. The extraction phase is driven out from the syringe's needle and exposed to the headspace of sample. The cooling process starts immediately and cools down the extraction phase (which is located inside the cooling capsule). After trapping the analytes onto the extraction phase, the extracted analytes is driven back into the needle and immediately injected to chromatographic system for subsequent analysis.

The main part of CHD is a cooling capsule which consists of two concentric copper tubes and two stainless steel capillary tubes. The space between the concentric copper tubes is capped with welding and the two stainless steel capillary tubes are inserted in one end of the copper tubes for entry and exit of liquid CO2. The liquid CO2 is passed into the space between the two copper tubes and is depressurized to cool down the space to −20° C. A K-type thermocouple, connected to a handmade temperature controller, adjusts the temperature of the cooling capsule to preset values by switching a solenoid valve which controls the flow of liquid CO2. The cooling capsule is located into a 40 mL extraction vial, with a suitable amount of liquid or solid sample. The sample poured into the extraction vial is heated using a micro-heater fixed below the vial. The needle of the microsyringe used in SPME or LPME methods passes through the septum of the extraction vial and the sample is extracted out and passed into headspace of sample on the center part of the cooling capsule. Then, cooling process starts immediately and cools down the extracted sample. Finally, after trapping of analytes, the extracted sample is driven back into the needle and immediately injected into chromatographic system for subsequent analysis.

The heating/cooling device (CHD) has many advantages compared to previous reported devices and are listed as follows. the system is applicable for cooling all types of extraction phase, such as solid fibers in SPME, liquid organic drops in LPME, and solid sorbents in needle trap device (NTD) or internally coated tube SPME (In-tube SPME).

All the parts and tools of the system are simple. The system is a low cost device and is designed and constructed in laboratory easily. Unlike previous reported systems, precise temperature controlling for the extraction phase is provided. The system is able to accurately adjust temperature of extraction phase over the range of −20-250° C. Because of the possibility of fine adjustment of temperature and ability to set temperature too low, the use of volatile organic solvents in LPME methods is possible. The system is used in industry, medicinal and agricultural products, environment pollutants, pharmaceuticals, medicinal herbs, and nano-materials is possible.

The CHD, with great trapping power for highly volatile compounds, is used as a convenient tool for tracing incurable diseases such as cancer and early detection, through the measurement of target compounds in human breath.

The CHD is configured to cool effectively down the extraction phase in different modes of headspace solid phase microextraction (HS-SPME) and headspace liquid phase microextraction (HS-LPME) methods. The CHD allows cooling of handmade fiber in SPME, needle in NTD and also other sorbents in SPE methods. By using CHD, volatile organic drop is used for LPME methods.

The cooling device, coupled to HS-SPME-GC-FID and -HF-HS-LPME-GC-FID, is successfully applied to determine and estimate different volatile analytes from contaminated solid samples directly without requiring any sample preparation process.

A Good agreement is observed between the results obtained by the proposed CHD-HS-SPME and CHD-HS-HF-LPME strategies and those obtained by the standard methods.

This system creates large temperature gaps between the extraction phase and the sample matrix (up to 200° C.), because the cooling process is directly applied onto the extraction phase. The relevant example data and their diagrams for evaluation of the developed system are presented in previous sections.

FIG. 1 illustrates a block diagram of a system for cooling the extraction phase in solid phase micro-extraction and liquid phase micro-extraction, according to an embodiment herein. With respect to FIG. 1, the system comprise a Carbon dioxide tank 101, a solenoid valve 102, a temperature controller 103, a sample vial 104, a cooling device 105, a holder mechanism 106, a heater and stirrer module 107, a power line 108 and a thermocouple 109. A Carbon dioxide tank 101 that delivers liquid Carbon dioxide is connected to the cooling device 105 through a solenoid valve 102 and the holder mechanism 106. The Liquid Carbon dioxide is passed into an internal space between the two cylinders the cooling device 105. Due to depressurization, the internal space in the cooling device 105 is cooled thereby cooling the extraction sample in an extraction phase. A thermocouple 109 is connected to the cooling device 105 and a temperature controller 103. The temperature controller 103 adjusts the temperature of the cooling device 105 to preset value. The temperature controller 103 is also connected to the solenoid valve 102 to control the switching ON and OFF of the cooling device 105. A suitable amount of sample matrix (not shown in the figure) is placed in a sample vial 104 and a cooling device 105 is fitted to the top cap of the sample vial 104. A suitable heater and stirrer module 107 heats the sample to release target analytes into the headspace of sample vial 104. After equilibration between sample and head-space, needle of a syringe containing micro-extraction fluid is passed through the extraction vial's cap and entered into an inner part of the cooling device 105. The cooling process starts immediately and cools down the extraction phase, which is located inside the cooling capsule. After trapping analytes in the extraction phase, the fluid driven back into the needle and immediately injected to chromatographic system for subsequent analysis.

Figure 2A:
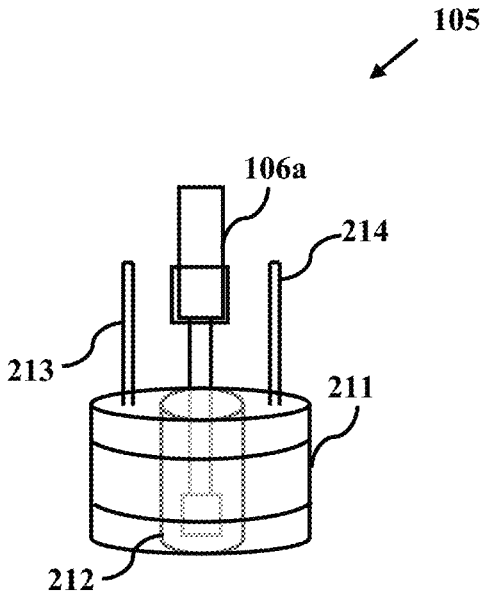
FIG. 2*a* illustrates a block diagram of a cooling/heating device (CHD) for the liquid phase micro-extraction system (LPME) for head space analysis, according to an embodiment herein.

FIG. 2*a* illustrates a block diagram of a cooling/heating device (CHD) for the liquid phase micro-extraction system (LPME) for head space analysis, according to an embodiment herein. With respect to FIG. 2*a*, the device comprises an outer cylinder 211, an inner cylinder 212, an inlet tube 213, an outlet tube 214 and a holder mechanism 106*a*. Liquid carbon dioxide enters the cooling device through the inlet tube 213, flows through the space in between the outer cylinder 211 and inner cylinder 212 and then flows out of the cooling device through the outlet tube 214. The holder mechanism 106*a* holds the parts of the cooling device in their places.

Figure 2B:
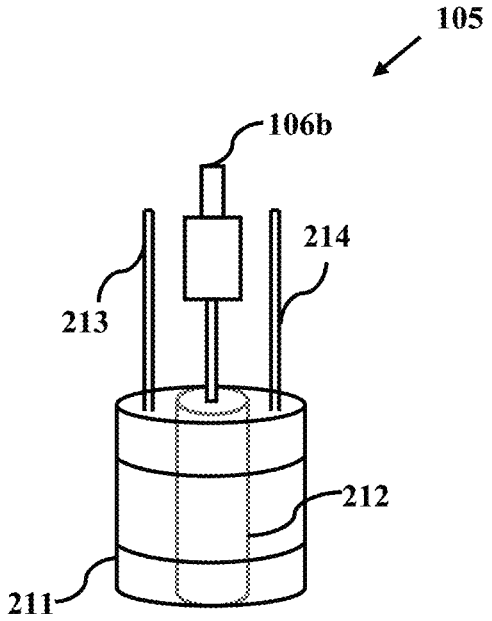
FIG. 2*b* illustrates a block diagram of a system of a cooling/heating device (CHD) for the solid phase micro-extraction system (SPME) for headspace analysis, according to an embodiment herein.

FIG. 2*b* illustrates a block diagram of a system of a cooling/heating device (CHD) for the solid phase micro-extraction system (SPME) for headspace analysis, according to an embodiment herein. With respect to FIG. 2*b*, the device comprises an outer cylinder 211, an inner cylinder 212, an inlet tube 213, an outlet tube 214 and a holder mechanism 106*b*. Liquid carbon dioxide enters the cooling device through the inlet tube 213, flows through the space in between the outer cylinder 221 and inner cylinder 212 and then flows out of the cooling device through the outlet tube 214. The holder mechanism 106*b* holds the parts of the cooling device in their places.

Figure 3A:
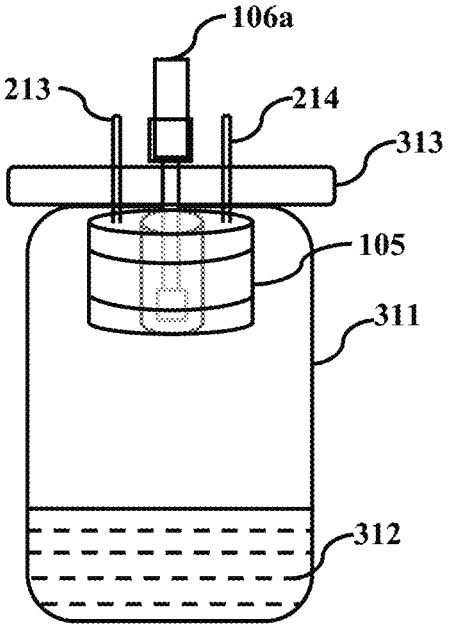
FIG. 3*a* illustrates a block diagram of a system for hollow fiber liquid phase micro-extraction system for head space analysis (HF-HS-LPME), according to an embodiment herein.

FIG. 3*a* illustrates a block diagram of a system for hollow fiber liquid phase micro-extraction system for head space analysis (HF-HS-LPME), according to an embodiment herein. With respect to FIG. 3*a*, the system comprises a sample vial 311, the sample matrix 312, a lid 313 and the cooling device 201. The sample matrix 312 is heated by heating the sample vial 311 and simultaneously cooled by passing liquid carbon dioxide through the cooling device 201. The liquid carbon dioxide enters the cooling device 201 through the inlet pipe 213, cools the sample matrix 312 and exits through the outlet pipe 214.

Figure 3B:
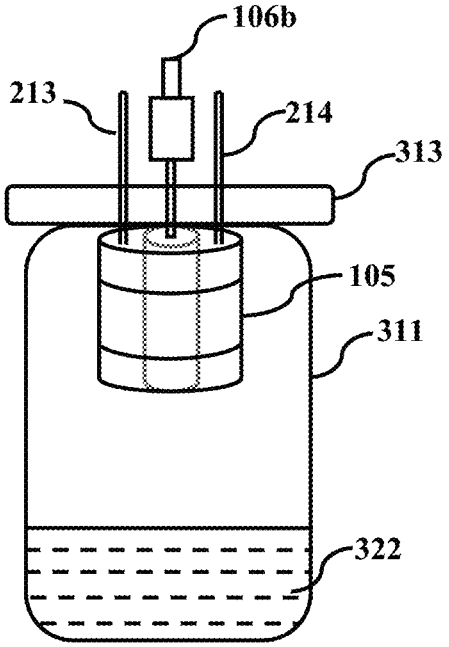
FIG. 3*b* illustrates a block diagram of a system for solid phase micro-extraction system for head space analysis (HS-SPME), according to an embodiment herein.

FIG. 3*b* illustrates a block diagram of a system for solid phase micro-extraction system for head space analysis (HS-SPME), according to an embodiment herein. With respect to FIG. 3*b*, the system comprises a sample vial 311, the sample matrix 322, a lid 313 and the cooling device 202. The sample matrix 322 is heated by heating the sample vial 311 and simultaneously cooled by passing liquid carbon dioxide through the cooling device 202. The liquid carbon dioxide enters the cooling device 202 through the inlet pipe 213, cools the sample matrix 322 and exits through the outlet pipe 214.

Figure 4:
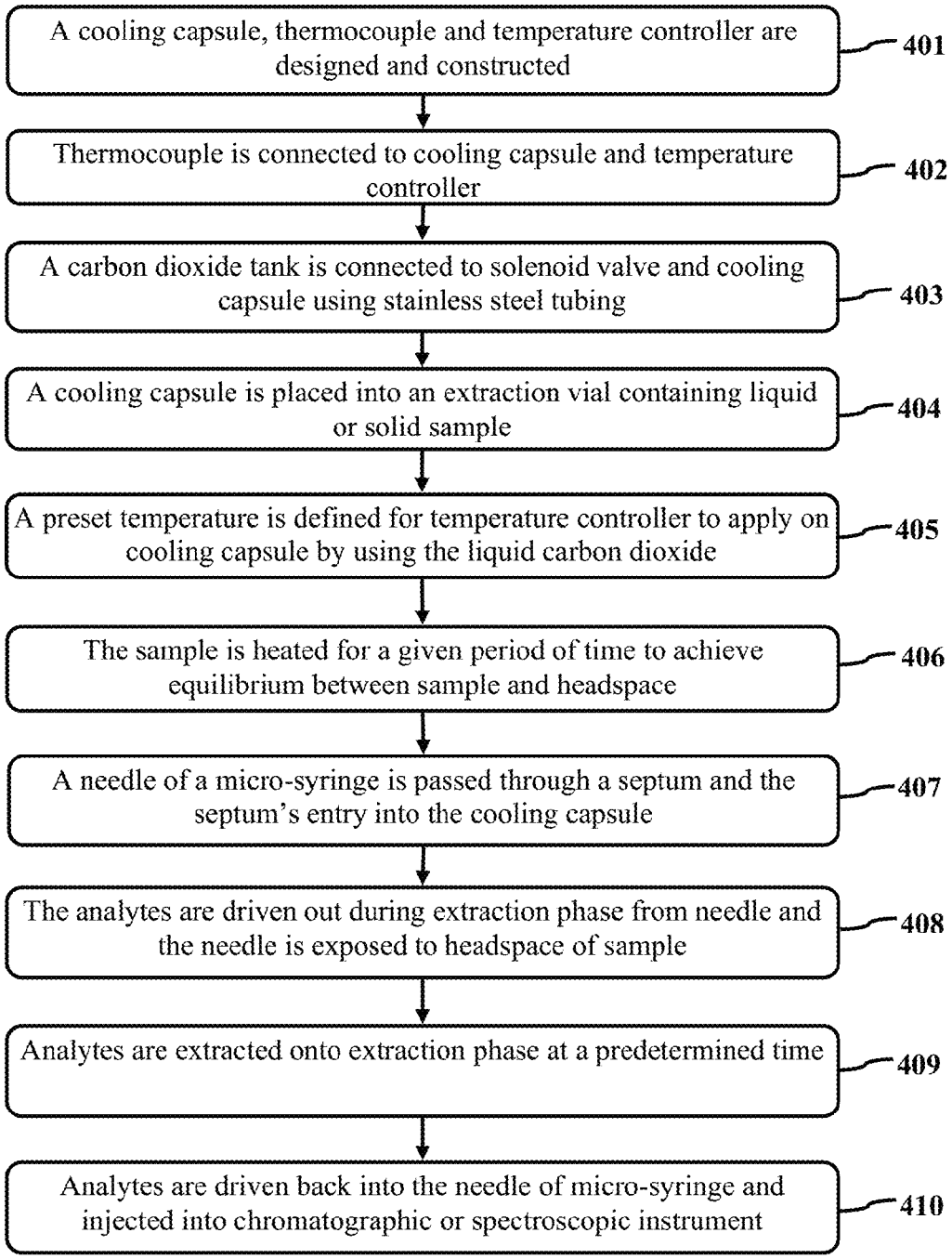
FIG. 4 illustrates a flowchart explaining the process steps in liquid phase micro-extraction and solid phase micro-extraction methods using the cooling and heating device, according to an embodiment herein.

FIG. 4 illustrates a flowchart explaining the process steps in liquid phase micro-extraction and solid phase micro-extraction methods using the cooling and heating device, according to an embodiment herein. with respect to FIG. 4, the process comprises the following steps: design and construction of cooling capsule, thermocouple and temperature controller (401); connecting thermocouple to cooling capsule and temperature controller (402); connecting carbon dioxide tank to solenoid valve and to cooling capsule using stainless steel tubing (403); locating cooling capsule into an extraction vial containing liquid or solid sample (404); defining a preset temperature for temperature controller to apply on cooling capsule using liquid carbon dioxide (405); heating sample for a given period of time for equilibration between sample and headspace (406); passing the needle of a micro-syringe through the septum and its entry into the cooling capsule (407); driving out extraction phase from needle and expose needle to headspace of sample (408); extraction of the analyses onto extraction phase at a predetermined time (409); and driving back the extractions phase into the needle of micro-syringe and inject it to chromatographic or spectroscopic instrument (410).

Figure 5:
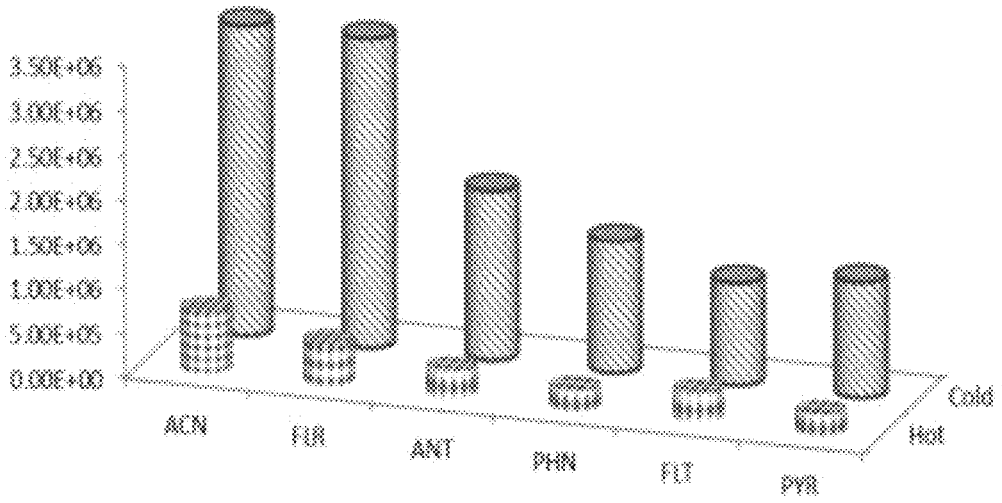
FIG. 5 illustrates a chart indicating a comparison between the extraction efficiency of polycyclic aromatic hydrocarbons (PAHs) in soil samples using Gas chromatography-flame ionization detection (CHD-HS-SPME-GC-FID) method according to an embodiment herein and a conventional or prior art method.

FIG. 5 illustrates a chart indicating a comparison between the extraction efficiency of polycyclic aromatic hydrocarbons (PAHs) in soil samples using Gas chromatography-flame ionization detection (CHD-HS-SPME-GC-FID) method according to an embodiment herein and a conventional or prior art method.

To optimize different experimental parameters affecting the extraction efficiency of the cooling device, the cooling/heating device is coupled to SPME and LPME systems and carried out to extract polycyclic aromatic hydrocarbons (PAHs) from spiked standard sand samples. The studied parameters include a temperature of sample matrix, a temperature of extraction phase (fiber in SPME and drop in LPME), an extraction time, and a moisture content of sample matrix. Finally, the simultaneous heating/cooling device is coupled to headspace solid-phase micro extraction and gas chromatography-flame ionization detection (CHD-HS-SPME-GC-FID) systems to determine PAHs in contaminated soils, using commercial and handmade SPME fibers. The analytical performances for six PAHs determined in contaminated soil samples using CHD-HS-SPME-GC-FID are listed in Table 1.

TABLE 1

The results of analytical performances for six PAHs in soil sample analyzed by the CHD-HS-SPME-GC-FID method.

| Analyte | LOD ($ngg^{-1}$) | RSD % (n = 6) | LDR ($\mu gg^{-1}$) | Equation | $R^2$ |
|---|---|---|---|---|---|
| Acenaphthene | 0.89 | 10.3 | 0.0029-10 | y = 2E + 06x + 3381 | 0.9987 |
| Fluorene | 0.78 | 5.9 | 0.0026-10 | y = 2E + 06x + 162928 | 0.9975 |
| Anthracene | 0.52 | 8.4 | 0.0017-10 | y = 629013x + 449819 | 0.9961 |
| Phenanthrene | 0.64 | 9.06 | 0.0021-10 | y = 407076x + 288818 | 0.996 |
| Fluoranthene | 0.47 | 8.3 | 0.0015-10 | y = 215528x + 232945 | 0.9938 |
| Pyrene | 0.53 | 8.9 | 0.0017-10 | y = 271197x + 275427 | 0.9986 |

Figure 6:
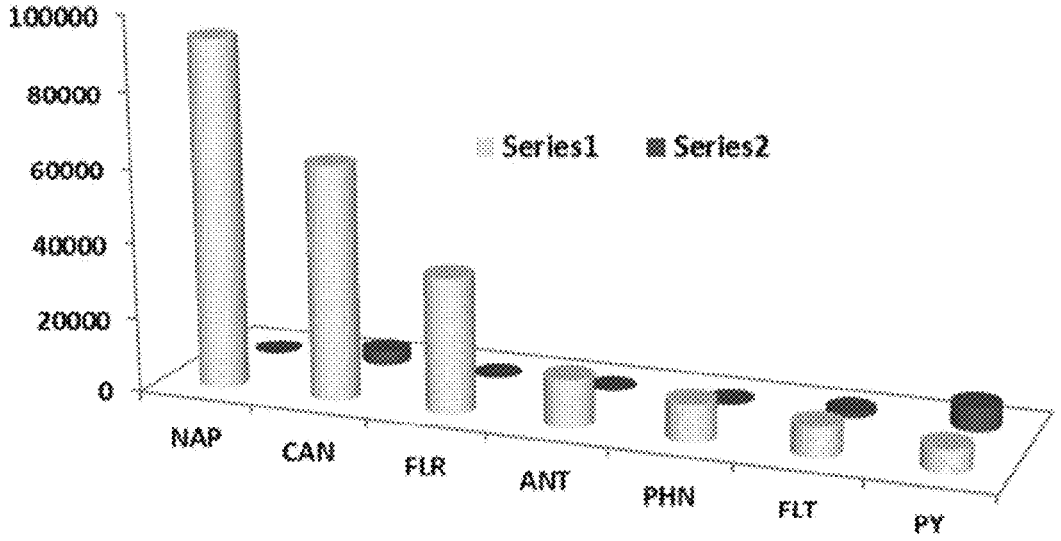
FIG. 6 illustrates a chart indicating a comparison between the extraction efficiency of polycyclic aromatic hydrocarbons (PAHs) in volatile organic solvents (liquid) samples (acetone series) and low volatile organic solvents (liquid) samples (Octanol) using Gas chromatography-flame ionization detection (CHD-HS-LPME-GC-FID) method according to an embodiment herein and a conventional or prior art method.

FIG. 6 illustrates a chart indicating a comparison between the extraction efficiency of polycyclic aromatic hydrocarbons (PAHs) in volatile organic solvents (liquid) samples (acetone series) and low volatile organic solvents (liquid) samples (Octanol) using Gas chromatography-flame ionization detection (CHD-HS-LPME-GC-FID) method according to an embodiment herein and a conventional or prior art method.

To evaluate the CHD-HS-SPME-GC-FID system, the extraction samples obtained in the CHD-HS-SPME-GC-FID system is compared to conventional HS-SPME-GC-FID, under optimum condition, to determine PAHs in soil sample. The results summarized in FIG. 6 clearly show that cooling of the fiber increases significantly the efficiency of extraction.

The simultaneous heating/cooling device, is coupled to headspace hollow fiber-based liquid-phase micro extraction and gas chromatography-flame ionization detection (CHD-HS-HF-LPME-GC-FID), to extract and determine seven PAHs from contaminated soil samples. Due to the use of CHD, volatile organic solvents are used in HF-LPME method for the first time. Table 2 shows the analytical performances for seven PAHs in soil samples using CHD-HS-HF-LPME-GC-FID method.

TABLE 2

Analytical performances for seven PAHs extracted from contaminated soil samples using CHD-HF-LPME-GC-FID procedure.

| Analyte | LOD (ng g−1) | RSD % (n = 5) | LDR (μg g−1) | Equation | $R^2$ |
|---|---|---|---|---|---|
| Naphthalene | 0.02 | 12.97 | 0.001-10 | Y = 167477x − 12628 | 0.9934 |
| Acenaphthene | 0.01 | 10.14 | 0.001-10 | Y = 57228x + 22785 | 0.9877 |
| Fluorene | 0.03 | 14.64 | 0.001-10 | Y = 28178x + 20871 | 0.9937 |
| Anthracene | 0.1 | 8.7 | 0.001-10 | Y = 7900.3x + 11086 | 0.9934 |

TABLE 2-continued

Analytical performances for seven PAHs extracted from contaminated soil samples using CHD-HF-LPME-GC-FID procedure.

| Analyte | LOD (ng g−1) | RSD % (n = 5) | LDR (μg g−1) | Equation | $R^2$ |
|---|---|---|---|---|---|
| Phenanthrene | 0.1 | 16.9 | 0.001-10 | Y = 2315.2x + 6852.9 | 0.9905 |
| Fluoranthene | 0.03 | 17.14 | 0.001-10 | Y = 1872.6x + 5233.6 | 0.9982 |
| Pyrene | 0.03 | 14.33 | 0.001-10 | Y = 1816.7x + 4509.2 | 0.9927 |

To evaluate the applicability of the CHD-HS-HF-LPME with volatile organic solvents, the amount of PAHs in soil samples is estimated using acetone. The results are compared to those obtained by octanol which is a low volatile solvent. The results shown in FIG. 6 clearly revealed that cooling of the organic solvent makes acetone a good extracting agent for PAHs without evaporating during the extraction process. It is also concluded that using volatile organic solvents provided higher extraction efficiencies than low volatile ones.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments.

It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A system for simultaneous heating and cooling of sample matrix during solid or liquid phase micro-extraction processes, the system comprising:

a sample vial to hold a sample matrix from which analytes are extracted using solid or liquid phase micro-extraction process;

a heating arrangement provided below the sample vial to heat the sample matrix in the sample vial, and wherein the heating arrangement is a micro-heater;

a cooling device attached to a top of the sample vial for cooling the sample matrix;

a carbon dioxide source to supply liquid carbon dioxide to the cooling device for cooling the sample matrix;

a solenoid valve provided between the carbon dioxide source and the cooling device, and wherein the solenoid valve is configured to act as an interface;

a temperature controller module connected to the cooling device and the solenoid valve to control a temperature of the cooling device;

a thermocouple module connected between the temperature controller and the cooling device to measure a temperature of the cooling device;

an extraction vial for receiving an analyte extracted from the sample during solid or liquid phase micro-extraction processes; and a power line connected to the temperature controller module;

wherein the solenoid valve is heated and cooled simultaneously during the extraction process to increase a release of analytes from the sample.

2. The system according to claim 1, wherein the cooling device comprises:

an outer metallic cylinder;

an inner metallic cylinder placed concentrically inside the outer metallic cylinder for housing the sample vial comprising the sample matrix;

an inlet metallic tube for passing the liquid carbon dioxide into a space between the outer metallic cylinder and the inner metallic cylinder for cooling the sample matrix in the sample vial;

an outer metallic tube for exiting the liquid carbon dioxide from the cooling device; and a holder mechanism to hold the cooling device in place and enable extraction of the analytes;

wherein the sample vial is heated and cooled simultaneously during the extraction process to increase a release of analytes from the sample.

3. The system according to claim 1, wherein a size of the outer metallic cylinder and a size of the inner metallic cylinder are suitable adjusted so that the cooling device is configured for use in liquid phase micro-extraction and/or solid phase micro-extraction processes.

4. The system according to claim 2, wherein the space between the outer metallic cylinder and the inner metallic cylinder is capped with a disc and wherein the disc is welded to the space.

5. The system according to claim 2, wherein the inlet metallic tube and the outer metallic tube are stainless steel capillary tubes, and wherein the inlet metallic tube is inserted into the space at one end of the capped space for passing liquid carbon dioxide inside the cooling device, and wherein the outer metallic tube is inserted at another end of the capped space for exiting liquid carbon dioxide out of the cooling device, and wherein both the inlet stainless steel capillary tube and the outlet stainless steel tube are stainless steel tube of 22 Gauge.

6. The system according to claim 2, wherein the outer metallic cylinder and the inner metallic cylinders are copper cylinder.

7. The system according to claim 1, wherein the thermocouple module comprises a K-type (Alum-Chrome) thermocouple and wherein wires of the thermocouple are inserted into the sample vial to measure a temperature of the sample vial.

8. The system according to claim 1, wherein the temperature controller regulates switch on/off operation of the solenoid valve based on a measured temperature of the sample vial to control a flow of the liquid carbon di-oxide into the space to adjust a temperature of the cooling device to preset value.

9. The system according to claim 1 further comprise a micro-syringe with a needle inserted into the extraction vial to hold the analytes in center of the extraction vial and to hold the analytes for analysis.

10. A method for simultaneous heating and cooling of sample matrix during solid or liquid phase micro-extraction processes, the method comprises:

placing a sample matrix in a sample vial;

placing the sample vial inside a cooling device;

heating the sample in the sample matrix with a heater arrangement, and wherein the heater is a micro-heater, and wherein the sample is heated for preset time for preset time to attain an equilibrium of sample in the head space of the sample vial;

placing an extraction vial into a head space of the sample vial for receiving an analyte extracted from the sample matrix in the sample vial;

inserting a needle of a syringe into the extraction vial to receive and hold the analytes at the center of the extraction vial;

delivering liquid carbon dioxide from a carbon dioxide source to the cooling device through a solenoid valve and stainless steel tubes to cool the analytes sample vial, and wherein the analytes are cooled to preset temperature;

extracting the analytes at the needle at a preset time; and injecting the analytes into a chromatographic or spectroscopic instrument for analysis of polycyclic aromatic hydrocarbons (PAHs);

wherein the sample is simultaneously heated and cooled simultaneously during the extraction process to increase a release of analytes from the sample.

11. The method according to claim 10, wherein the sample is placed in a space between two copper tubes in the cooling device.

12. The method according to claim 10, wherein liquid carbon dioxide is passed into the space between the two copper tubes in the cooling device and depressurized.

13. The method according to claim 10, wherein the space is cooled due to depressurization of liquid carbon di-oxide.

14. The method according to claim 10 further comprises connecting a temperature controller module to the cooling device and the solenoid valve to control a temperature of the cooling device.

15. The method according to claim 10 further comprises connecting a thermocouple module between the temperature controller and the cooling device to measure a temperature of the cooling device.

16. The method according to claim 10 further comprises controlling a switching on/off operations of the solenoid valve based on a measured temperature of the cooling device to regulate a flow of the carbon di oxide to maintain a temperature of the cooling device at a preset value.

17. The method according to claim 10 further comprises adjusting a size of the two copper tubes in the cooling device so that the cooling device is configured for use in liquid phase micro-extraction and/or solid phase micro-extraction processes.

* * * * *